United States Patent [19]

Pozzato et al.

[11] Patent Number: 5,058,815

[45] Date of Patent: Oct. 22, 1991

[54] HAMMER MILL FOR CRUSHING ORE AND THE LIKE MATERIALS

[76] Inventors: Alberto Pozzato, Via Sant'Eurosia, 10, Breganze; Mariano Pozzato, Via del Rovere, 2, Sandrigo, both of Italy

[21] Appl. No.: 330,261

[22] Filed: Mar. 29, 1989

[30] Foreign Application Priority Data

Apr. 14, 1988 [IT] Italy ..... 20201 A/88

[51] Int. Cl.[5] ..... B02C 13/26

[52] U.S. Cl. ..... 241/192; 241/191; 241/195; 241/275; 241/300

[58] Field of Search ..... 241/189 R, 191, 192, 241/195, 197, 275, 300, 285 B

[56] References Cited

U.S. PATENT DOCUMENTS

| | | | |
|---|---|---|---|
| 1,130,251 | 3/1915 | Boero | 241/189 R |
| 1,936,599 | 11/1933 | Hartshorn | 241/285 B X |
| 1,996,485 | 10/1932 | Parker | 83/11 |
| 2,310,758 | 2/1943 | Werner et al. | 241/197 X |
| 2,588,434 | 3/1952 | Unti et al. | 241/189 R X |
| 4,009,836 | 3/1977 | Strom et al. | 241/285 B X |
| 4,373,678 | 2/1983 | Reitter | 241/189 R |
| 4,557,421 | 12/1985 | Probst et al. | 241/285 B X |

FOREIGN PATENT DOCUMENTS

| | | |
|---|---|---|
| 2265456 | 10/1975 | France . |
| 678428 | 9/1952 | United Kingdom . |

*Primary Examiner*—Timothy V. Eley

*Attorney, Agent, or Firm*—Fitzpatrick, Cella, Harper & Scinto

[57] ABSTRACT

A hammer mill for crushing ore and the like materials comprises a cylindrical case provided with armor plates on its inside, and a rotor journalled in the case and carrying a plurality of hammers, as well as anchor means for holding each hammer to the rotor at a position facing the armor plates, which includes a mortise, formed at the rotor periphery and having opposed walls convergent outwardly and substantially dovetail-like, and a tenon formed on the hammer integrally therewith and having a cross-sectional shape which matches that of the mortise, said tenon engaging with the mortise walls and being urged, by the centrifugal force developed within the hammer by the rotating rotor, to wedge itself stably in between said mortise walls.

5 Claims, 3 Drawing Sheets

HAMMER MILL FOR CRUSHING ORE AND THE LIKE MATERIALS

BACKGROUND

1. Field of the Invention

This invention relates to a hammer mill for crushing ore and the like materials, being of a type which comprises a substantially cylindrical case clad with armor plates on its inside, and a rotor journalled on the case and carrying a plurality of hammers, as well as anchor means for holding each hammer on the rotor at a position to confront the armor plates.

2. Description of the Related Art

Hammer mills for crushing ore and the like materials require that the hammers be secured to the rotor appropriately to enable the hammers to perform their function, which is one of striking the material to be crushed and throwing it with great force against the armor plates. Thus, the material will rebound in pieces from the armor plates, to be once again thrown by the hammers against the armor plates, and this until the material fragment size becomes so small as to drop through a gap or gaps between the rotor and armor plates out of the mill.

In view of the markedly abrasive action exerted by ore materials, the hammers are liable to wear out at a fast rate, and must be replaced with new ones at fairly frequent intervels.

Mills are known wherein the rotor is provided with pegs and the hammers are U-shaped, so that they can be mounted to the rotor each astride a respective one of the pegs. This prior design has the advantage that a hammer can be removed from the rotor more readily, but is deficient as relates to providing a secure attachment of the hammer to the rotor. In fact, with the mill in operation, relative movements occur between the hammer and the rotor leading to mutual impacts which may be substantial and result in the contacting surfaces becoming damaged, and in the extreme, in mechanical failure of either the hammers of the rotor.

Also known are mills in which each hammer has a slotted portion fitting in a corresponding seat formed on the rotor. This prior design does provide for a strong attachment of the hammer to the rotor, but still has a serious drawback which shows up each time that the hammers require to be replaced. Due to the ore powder present within the mill, which gets into the interstices between the mating slot profiles on the hammer and rotor, a "weld" fillet forms between the hammer and the rotor which makes the hammer removal from the rotor a laborious and time-consuming operation, with the net result of extending the mill downtime.

SUMMARY OF THE INVENTION

The problem that underlies this invention is to provide a mill of the type specified above which has such structural and performance characteristics as to meet the above-noted demands and at the same time to overcome the drawbacks with which the prior art is beset.

This problem is solved by a mill characterized in that said anchor means comprises a mortise, formed at the rotor periphery and having opposed walls arranged to converge outwards substantially dovetail-like, and a tenon, formed integrally with the hammer and having a cross-section shape matching that of the mortise and engaging with the walls thereof, the tenon being urged to wedge itself in a stable fashion in between said mortise walls by the centrifugal force applied to the hammer by the rotating rotor.

Further features and the advantages of a mill according to the invention can be more clearly understood by having reference to the following detailed description of a preferred embodiment thereof, to be taken by way of illustration and not of limitation in conjunction with the accompanying drawings, where:

DETAILED DESCRIPTION

Figure 1:
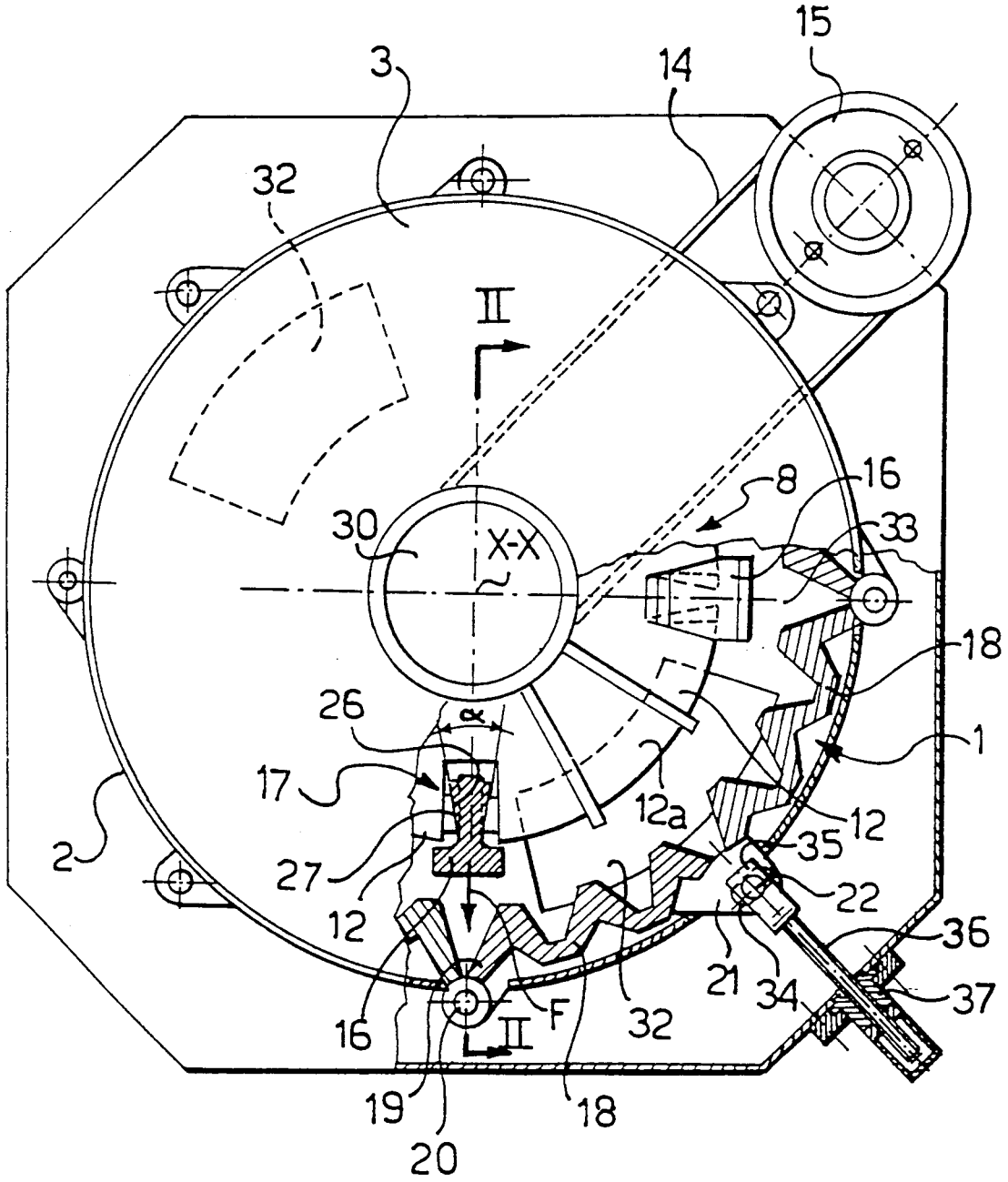
FIG. 1 is a part-sectional planview of a mill according to this invention, taken along the line I—I.

With reference to the accompanying drawing views, a hammer mill according to the invention comprises a substantially cylindrical case 1 having a vertical axis X—X, which is formed of a tubular skirt 2 closed at the top by an upper end cap 3 and at the bottom by a lower end cap 4.

Formed coaxially at the center of the lower end cap 4 is an annular stand 5 to which a tubular body 7 is attached coaxially via an elastic member 6 so as to form an extension of the stand.

The inventive mill also comprises a rotor 8 which is journalled on the case 1. In particular, the rotor 8 comprises a shaft 9 which is journalled, with the interposition of conventional rolling bearings, within the tubular body 7.

The shaft 9 has a top end 10 and a bottom end 11, both arrangd to project from the tubular body 7.

The rotor 8 includes a disk 12 which is keyed to the top end 10 of the shaft 9 coaxially therewith and has a top face 12*a*, positioned close to the upper end cap 3, and a bottom face 12*b*, as well as a periphery 12*c*.

Keyed to the bottom end 11 of the shaft 9 of the rotor 8 is a pulley 13 which is connected to an electric motor 15, supported on the case 1, by a drive belt 14.

The rotor 8 carries a plurality of hammers, collectively designated 16. More specifically, the hammers 16, being four in number in the example shown, are distributed at regular pitch intervals around the the periphery 12*c* of the disk 12.

An anchor means 17 is provided for each hammer 16 for mounting the hammers to the disk 12 of the rotor 8 at locations which face a plurality of armor plates, collectively designated 18, which are laid in a row around the entire inside circumference of the case 1.

The armor plates 18 are shaped as segments of a circular arc and secured on the tubular skirt 2 so as to line it completely at the level of the rotor hammers 16. In particular, each armor plate 18 has a first end 19 pivoted around a fixed pivot pin 20 mounted on the case interior, and an opposite second end 21 constrained radially through a circumferential slot 34 by a pin 22 which is carried on the case in a radially adjustable manner for setting the armor plate radial position.

More specifically, the pin 22 has a middle portion arranged to extend through the slot 34, and opposed ends secured on a yoke 35 having a radially extending, threaded lug 36 which engages threadably in a nut 37 supported rotatably on the case 1.

Advantageously, armor plates 18 adjoining one another in the row have their first ends 19 juxtaposed to each other and pivoted on a single common pivot pin 20 and their second ends also juxtaposed and held securely by a single common pin 22.

The anchor means 17 holding each hammer 16 on the disk 12 of the rotor 8 comprises a mortise 23, formed at the periphery 12*c* of the disk 12 of the rotor 8, and a tenon 24 formed integrally with the hammer 16.

The mortise 23 is formed axially through the periphery 12*c* of the disk 12. It includes an end or bottom wall 25 and opposite side walls, both indicated at 26, which converge in the outward direction. In other words, they substantially provide a dovetailed cross-section for the mortise; in addition, they form an acute angle alpha within the range of 5° to 20°, preferably equal to 10°.

The cross-sectional shape of the tenon 24 matches that of the mortise 23. In particular, it has sides, both indicated at 27, which form the same angle as the aforesaid angle alpha.

A hammer 16 would be mounted on the disk 12 such that its tenon 24 fits into the mortise 23. Each hammer 16 is provided with projections, both indicated at 28, which would bear on the top face 12*a* of disk 12 to provide a setting of the hammer in the axial direction relatively to the rotor.

A hole 16*a* is provided in the hammer 16 to lie level with the bottom face 12*b* and intended to be optionally engaged by a latch, not shown, retaining the hammer axially to the disk.

On driving the rotor rotatively, a radially directed centrifugal force F is developed within the hammer which urges the tenon 24 to wedge itself in the mortise 23 by engaging at its sides 27 in a stable fashion with the side walls 26 of the mortise.

The disk 12 defines, within the case 1, an upper chamber 29, into which ore material to be milled is fed through a central opening 30 formed in the upper end cap, and a lower chamber 31 whence the milled material, commonly referred to as "the fines", comes out through openings 32 formed in the lower end cap 4.

The upper chamber 29 and lower chamber 31 are communicated with each other by an interspace or gap 33 left between the periphery 12*a* of the disk 12 carrying the hammers and the armor plates 18.

The magnitude of this gap will determine the granulometric curve of the processed ore material.

In operation (refer to FIGS. 1 and 2), as the rotor is being driven rotatively, the hammers would be constantly urged away in the radial direction by the centrifugal force, indicated at F, to enhance their wedging, by the tenon, in the corresponding dovetail mortises. By virtue of the acute angle alpha between the mortise walls, such wedging would be a stable one and each hammer forced to become solid with the disk.

Ore material to be milled is fed through the opening 30 into the upper chamber 29 and crushed therein by the repeated throwing actions to which it is subjected by the hammers toward and against the armor plates, as well as the repeated rebounding from the armor plates.

Once the ore material feed has been reduced to "fines", it will drop into the lower chamber 31, whence it flows out through the openings 32.

Figure 3:
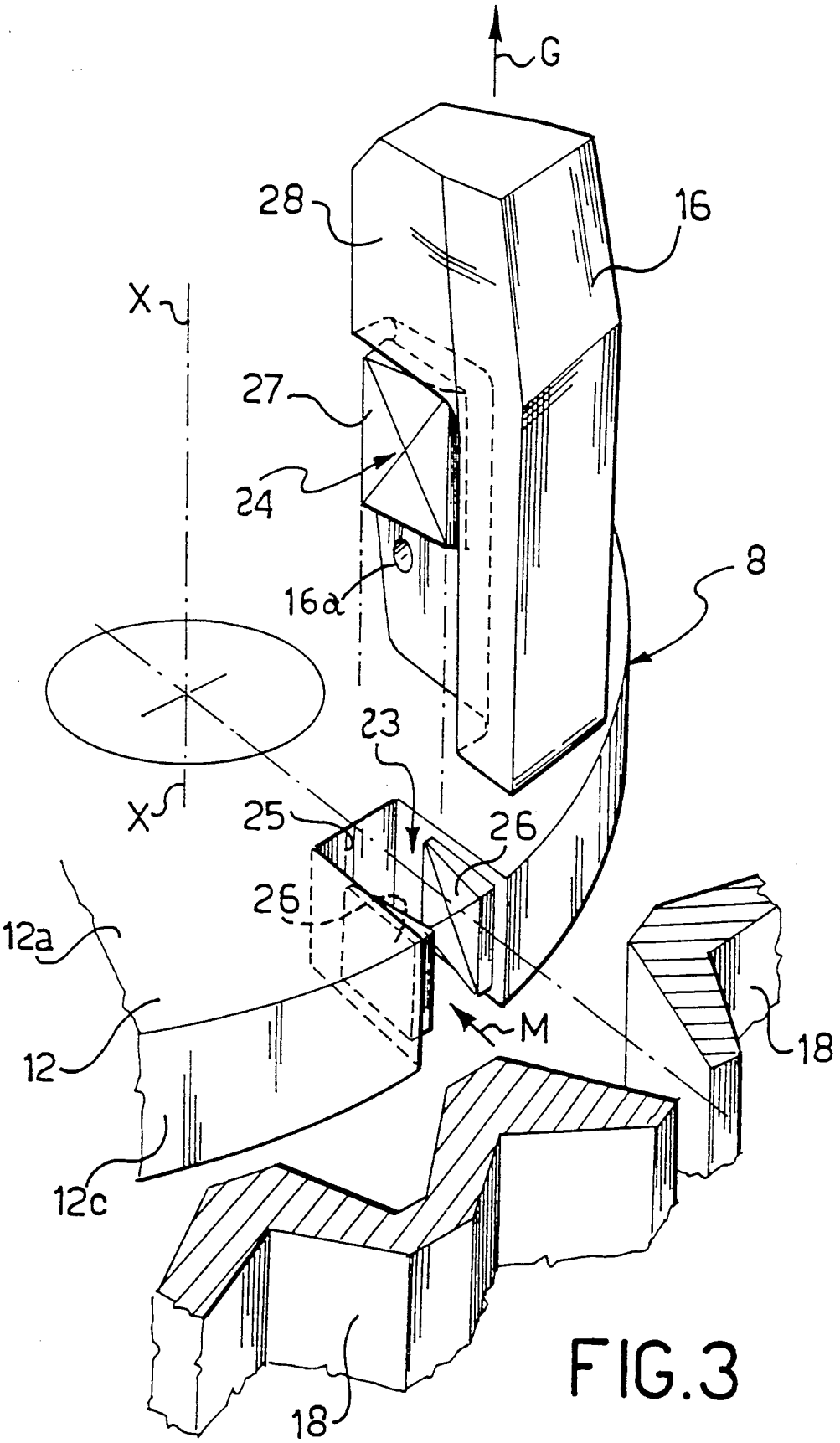
FIG. 3 is an exploded perspective view of a detail of the mill shown in FIG. 1.

When the hammers require to be replaced, such as on their reaching a wear threshold, it will be sufficient to strike them in a radial direction by some heavy object, along the direction M. The tenon will recede, under the blows, from its wedged state toward the bottom wall of the mortise, thus acquiring a degree of looseness within the mortise. Then, the hammer can be easily taken away from the disk in an axial direction, as indicated by the arrow G in FIG. 3.

A new hammer can be fitted, thereafter, by following the reverse procedure. The rotary motion of the rotor will then re-establish the desired stable engagement relationship betweeen the new hammer and the disk.

In order to keep the granulometric curve constant, despite the progressive wear occurring in the hammers and armor plates, the size of the gap would be restored by a radial adjustment of the armor plate settings, to be performed from the outside by manipulating the nuts. Thus, the pin positions are shifted in the radial direction and the armor plates caused to rotate slightly about their respectively pivots, to bring them closer to the rotor and, hence, restore the gap to its original size.

The hammer mill of this invention has shown a major advantage in that the firm attachment of the hammers to the rotor can be made highly effective while shortening the time required to replace wornout hammers.

A further major advantage of the inventive mill is that the working gap can be kept constant, despite the progressing wear, by simple and quickly-effected operations.

A further advantage of the mill according to the invention is that its construction can be kept simple without impairing its ability to deliver milled ore material of a high quality.

Understandably, a hammer mill as disclosed herein above may be altered and modified in many ways by a skilled person in the art, to meet specific contingent demands, without departing from the true scope of the invention as set forth in the appended claims.

We claim:

1. A hammer mill for crushing materials, comprising:

a cylindrical case clad with armor plates on its inside, a rotor journalled on the case and carrying a plurality of hammers, and anchor means for holding each hammer on the rotor at a position to confront the armor plates, said anchor means comprising a mortise formed at the rotor periphery and having opposed walls arranged to converge outwardly in a dovetail-like manner, the opposed walls of the mortise forming an angle therebetween within the range of 5° to 20°, the hammer including an integrally-formed tenon having a cross-sectional shape matching that of the mortise and engaging with the walls thereof, the tenon being urged to wedge itself in a stable fashion between said mortise walls by centrifugal force applied to the hammer by the rotating rotor.

2. A hammer mill according to claim 1, characterized in that said angle is equal to 10°.

3. A hammer mill according to claim 2, characterized in that the armor plates are in the form of segments of a circular arc laid in a row wherein each segment has a first end pivotally mounted on a pivot pin and a second end secured to a radially adjustable pin.

4. A hammer mill according to claim 3, characterized in that adjoining armor plates in the row have first ends juxtaposed and pivotally mounted to a common pivot pin.

5. A hammer mill according to claim 4, characterized in that adjoining armor plates in the row have second ends juxtaposed and secured to a common pin.

* * * * *

UNITED STATES PATENT AND TRADEMARK OFFICE

CERTIFICATE OF CORRECTION

PATENT NO. : 5,058,815

DATED : October 22, 1991

INVENTOR(S) : ALBERTO POZZATO, ET AL.

It is certified that error appears in the above-identified patent and that said Letters Patent is hereby corrected as shown below:

AT [57] ABSTRACT

Line 3, "in" should read --on--.

COLUMN 1

Line 29, "intervels." should read --intervals.--.

COLUMN 2

Figure 2:
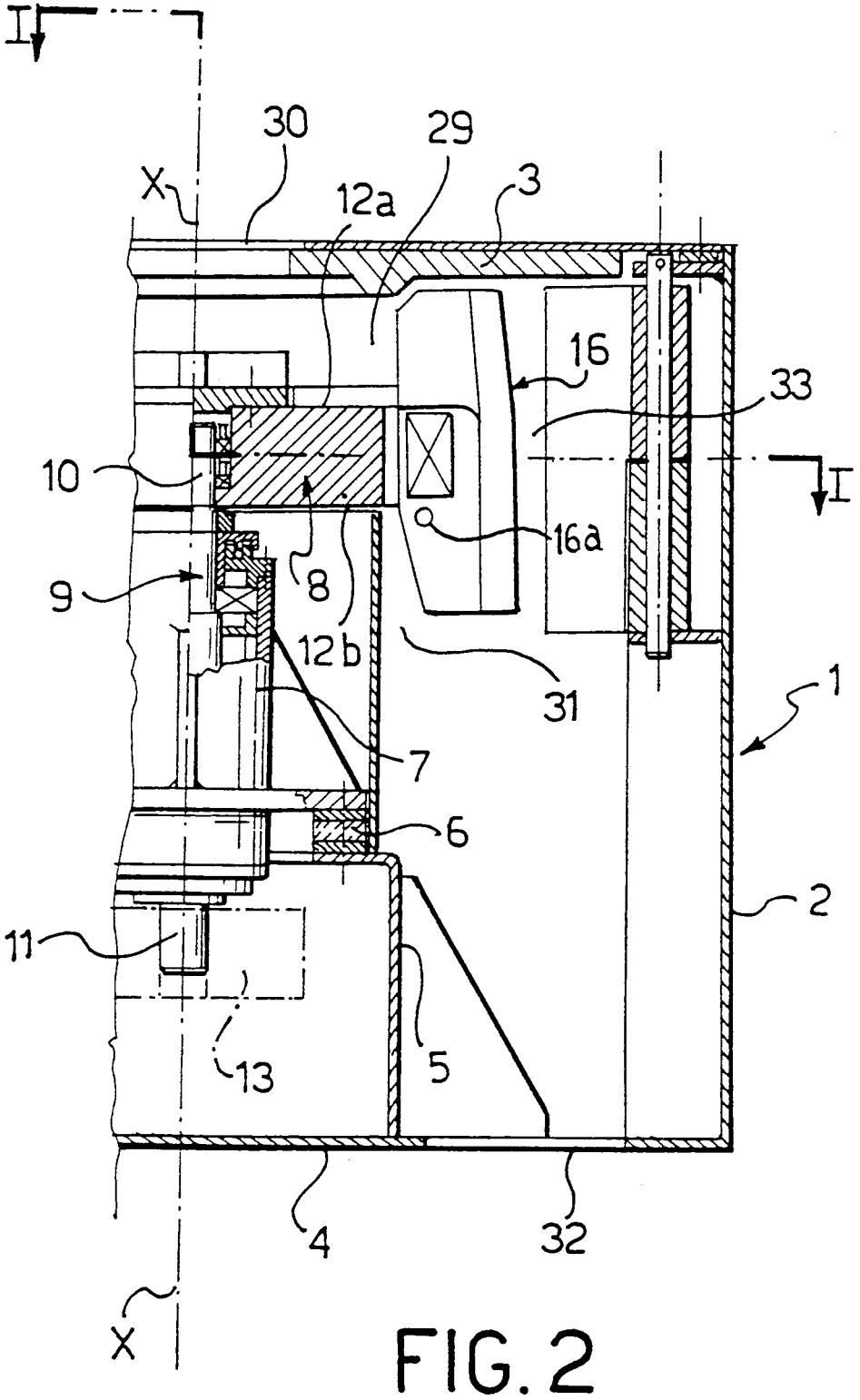
FIG. 2 is a part-sectional elevation view of the mill shown in FIG. 1, taken along line II—II.

Line 12, "line I-I;" should read
--line I-I shown in FIG. 2;--.

COLUMN 3

Line 39, "cap," should read --cap 3,--.
Line 61, "feed" should read --fed--.

UNITED STATES PATENT AND TRADEMARK OFFICE

CERTIFICATE OF CORRECTION

PATENT NO. : 5,058,815

DATED : October 22, 1991

INVENTOR(S) : ALBERTO POZZATO, ET AL.

It is certified that error appears in the above-identified patent and that said Letters Patent is hereby corrected as shown below:

COLUMN 4

Line 21, "wornout" should read --worn-out--.
Line 30, "herein" should read --herein- --.

Signed and Sealed this

Fourth Day of May, 1993

*Attest:*

*Attesting Officer*

Michael K. Kirk

MICHAEL K. KIRK

*Acting Commissioner of Patents and Trademarks*